US005986615A

United States Patent [19]

Westfall et al.

[11] Patent Number: 5,986,615

[45] Date of Patent: Nov. 16, 1999

[54] ANTENNA WITH GROUND PLANE HAVING CUTOUTS

[75] Inventors: Brian G. Westfall, Modesto; Kevin B. Stephenson, Mountain View, both of Calif.

[73] Assignee: Trimble Navigation Limited, Sunnyvale, Calif.

[21] Appl. No.: 08/934,146

[22] Filed: Sep. 19, 1997

[51] Int. Cl.[6] ..... H01Q 1/48

[52] U.S. Cl. ..... 343/846; 343/848; 343/700 MS

[58] Field of Search ..... 343/846, 848, 343/700 MS, 829; H01Q 11/38, 1/48, 9/38

[56] References Cited

U.S. PATENT DOCUMENTS

| | | | |
|---|---|---|---|
| 4,529,987 | 7/1985 | Bhartia et al. | 343/700 |
| 4,927,251 | 5/1990 | Sohoen | 350/503 |
| 4,965,603 | 10/1990 | Hong et al. | 342/372 |
| 5,061,938 | 10/1991 | Zahn et al. | 343/700 MS |
| 5,132,623 | 7/1992 | De et al. | 324/338 |
| 5,170,175 | 12/1992 | Kobus et al. | 343/895 |
| 5,204,685 | 4/1993 | Franchi et al. | 342/360 |
| 5,248,980 | 9/1993 | Raruenet | 342/354 |
| 5,592,174 | 1/1997 | Nelson | 342/357 |

FOREIGN PATENT DOCUMENTS

| | | | |
|---|---|---|---|
| 0318873 | 6/1989 | European Pat. Off. | H01Q 17/00 |
| 0394960 | 10/1990 | European Pat. Off. | H01Q 9/04 |
| 3738513 | 6/1989 | Germany | H01Q 13/00 |
| 4326117 | 2/1995 | Germany | H01Q 1/22 |
| 2057773 | 4/1981 | United Kingdom | H01Q 1/48 |

OTHER PUBLICATIONS

Synsthesis of Tapered Resistive Ground Plane for a Microstrip Antenna, 0–7803–2719–5/95/S4. 1995 IEEE, R.G. Rojas et al.

Analysis and Treatment of Edge Effects on the Radiation Pattern of a Microstrip Patch Antenna, 0–7803–2719–5/95/S4. 1995 IEEE, Michael F. Otero et al.

*Primary Examiner*—Don Wong
*Assistant Examiner*—Hoang Nguyen
*Attorney, Agent, or Firm*—Donald S. Dowden; Cooper & Dunham LLP

[57] ABSTRACT

An antenna structure has a radiating element and a ground plane. The ground plane has a central region relatively closely spaced apart from the radiating element and a peripheral region extending away from the central region. The peripheral region comprises at least the conductive layer that extends radially beyond the radiating element and provides a sheet resistivity higher than that of the radiating element. Though physically small, the ground plane simulates an infinite ground plane, and the antenna structure reduces multipath signals caused by reflection from the earth.

38 Claims, 20 Drawing Sheets

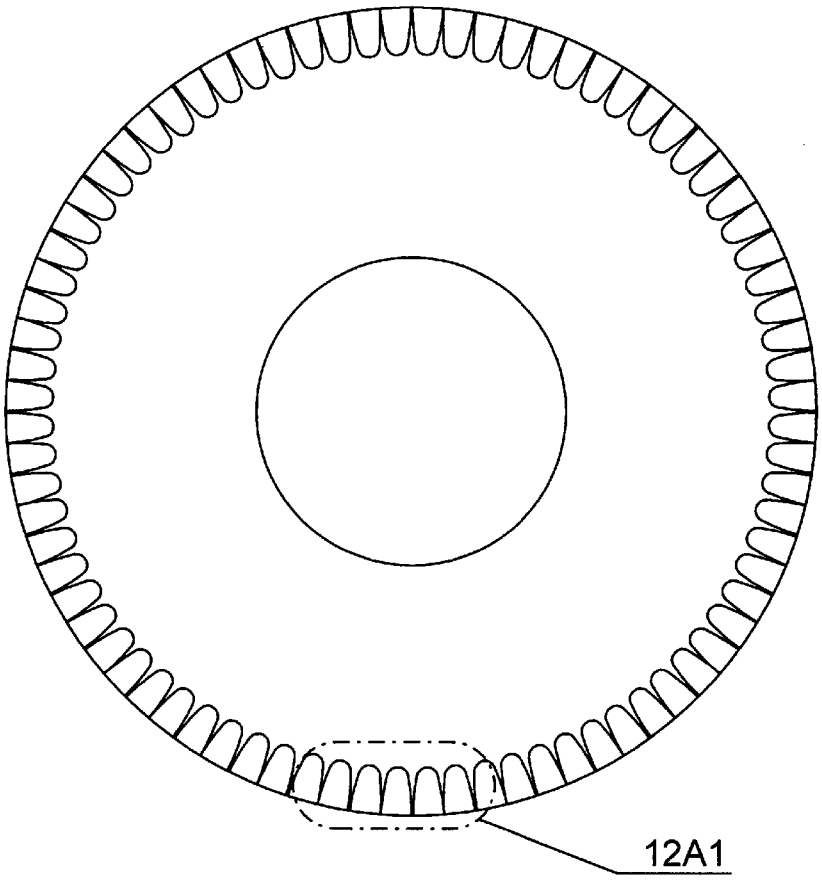
F I G. 12A
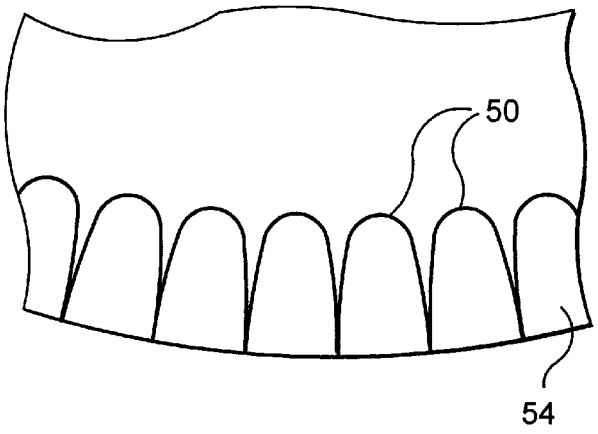
F I G. 12A1

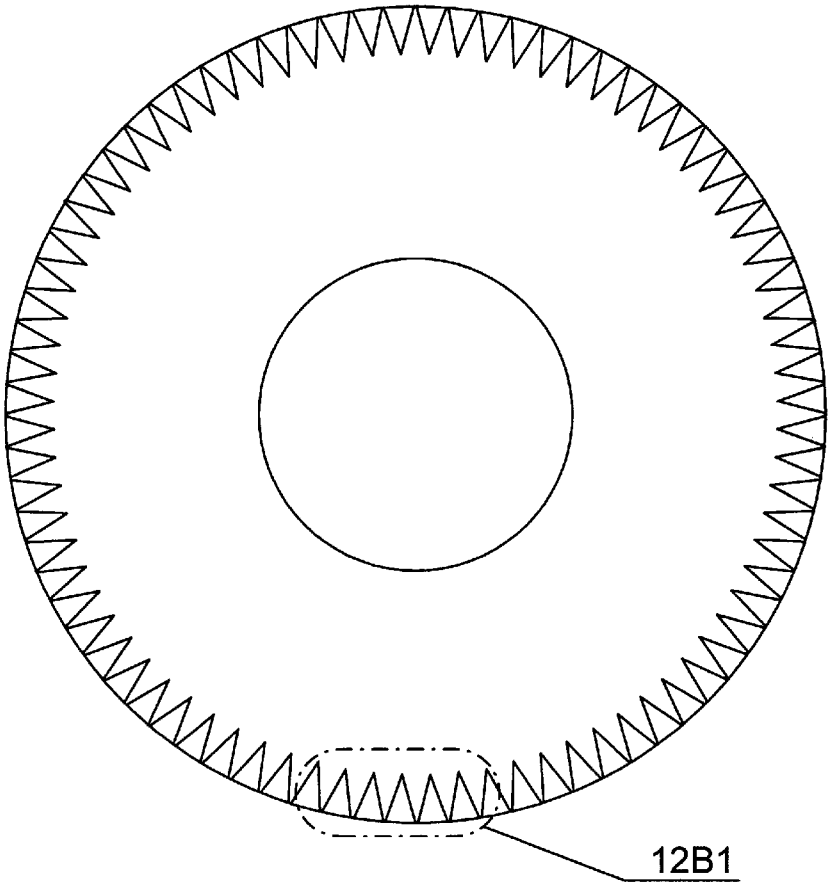
F I G. 12B
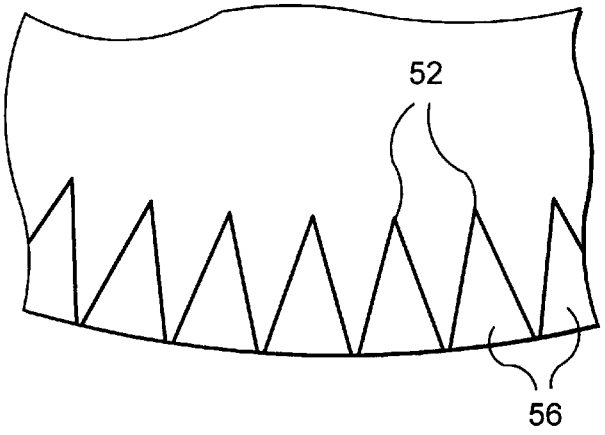
F I G. 12B1

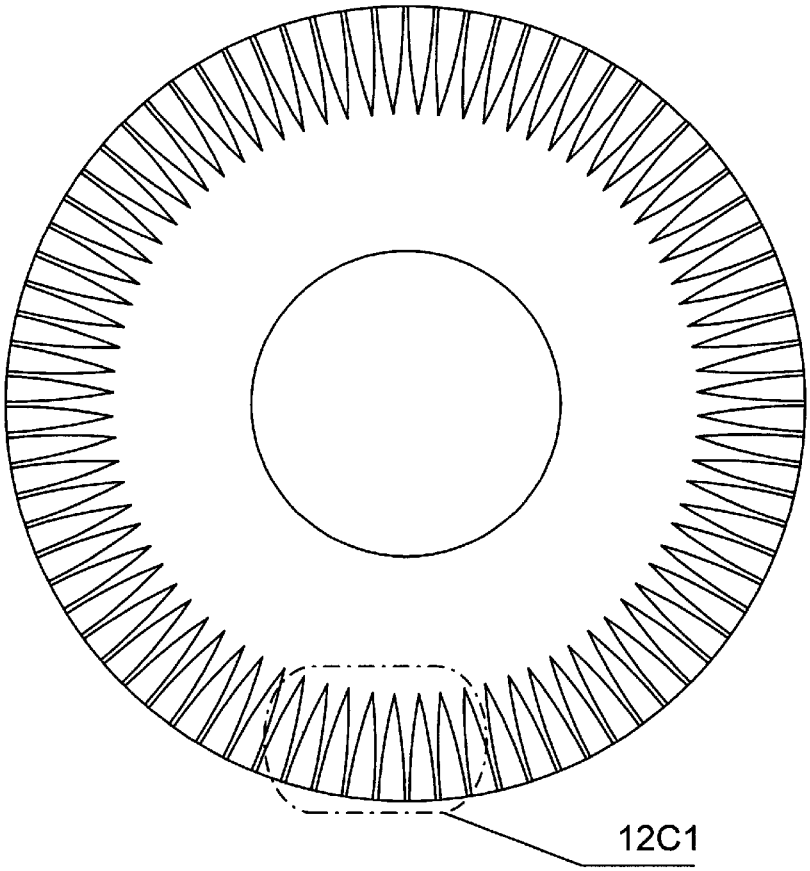
F I G. 12C
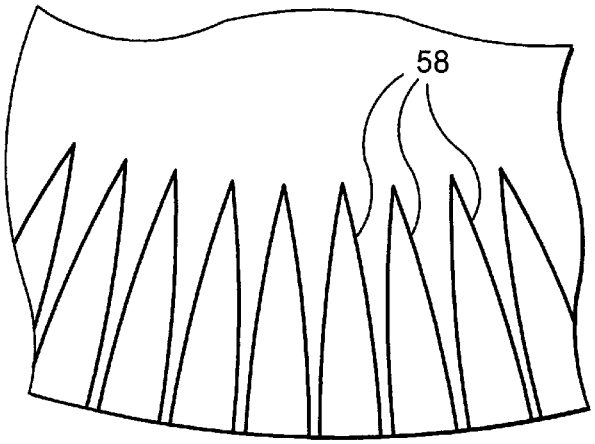
F I G. 12C1

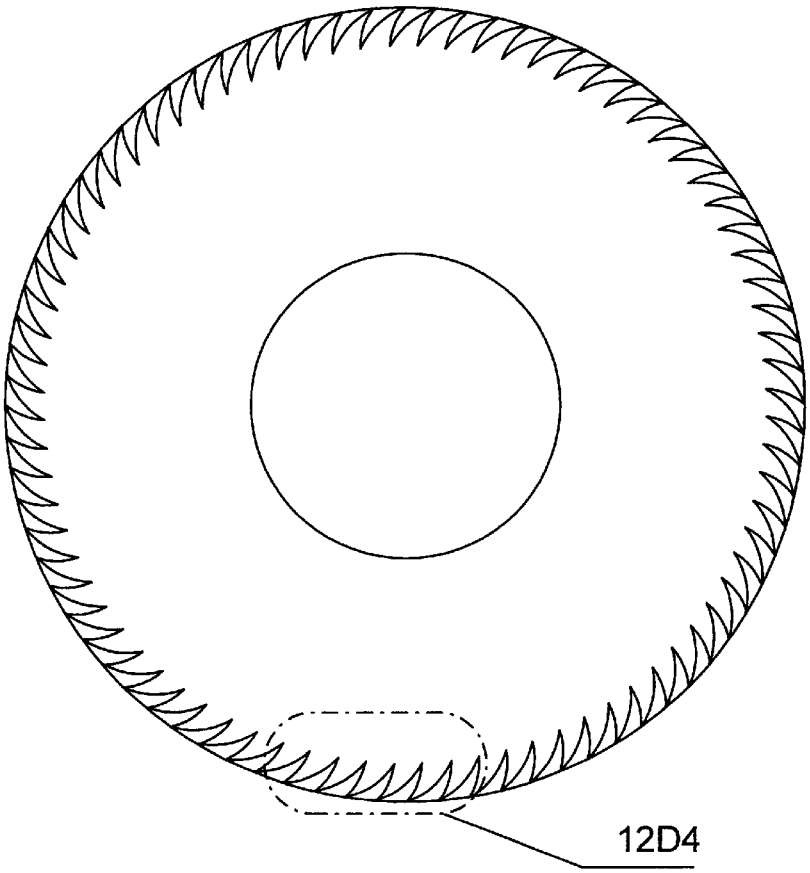
F I G. 12D
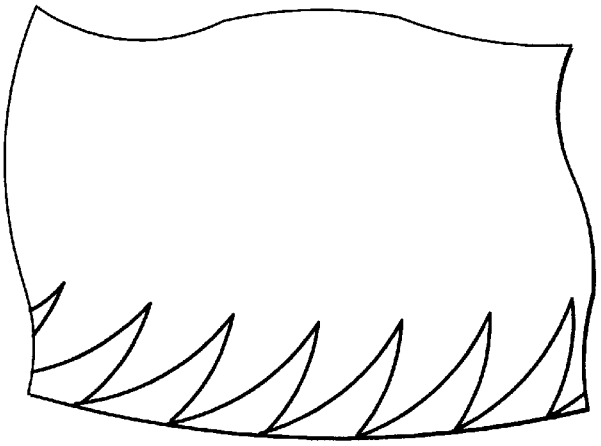
F I G. 12D4

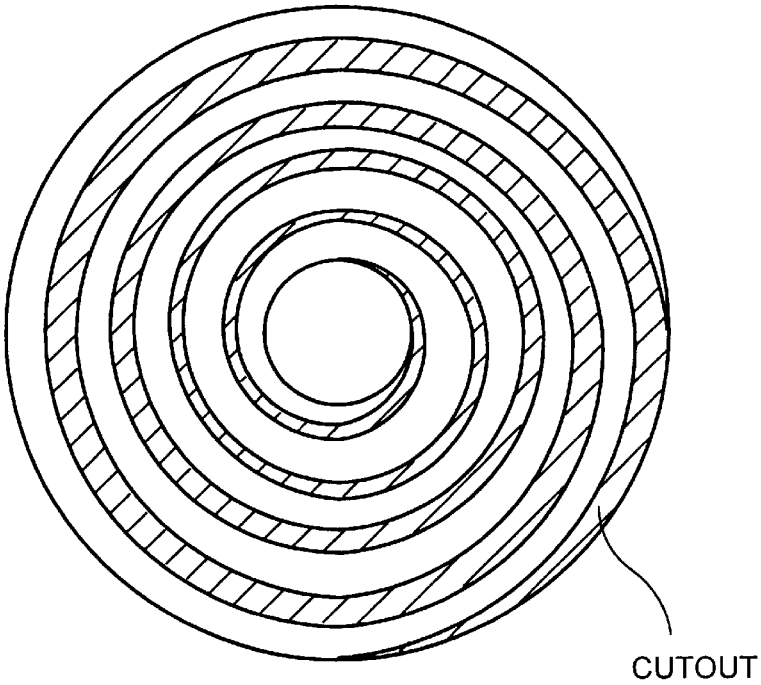
F I G. 12D1
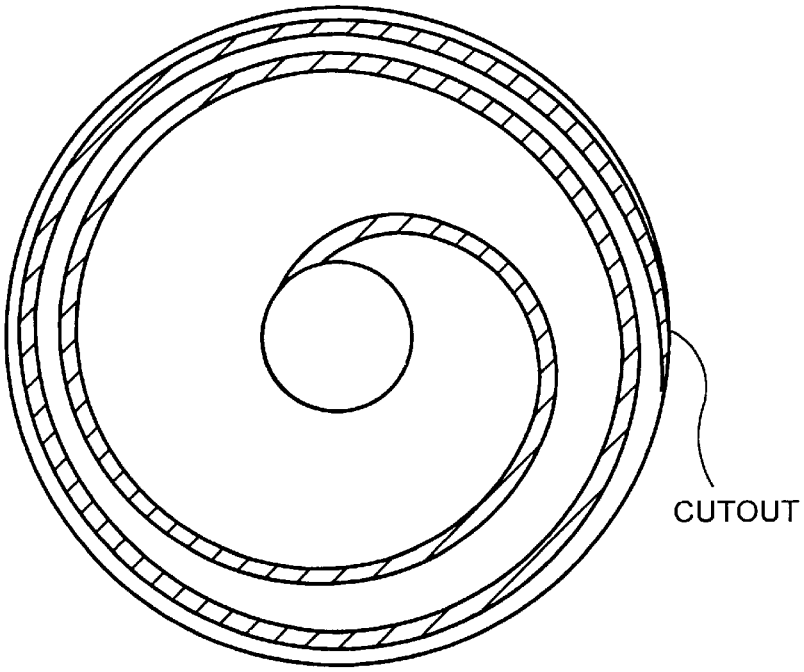
F I G. 12D2

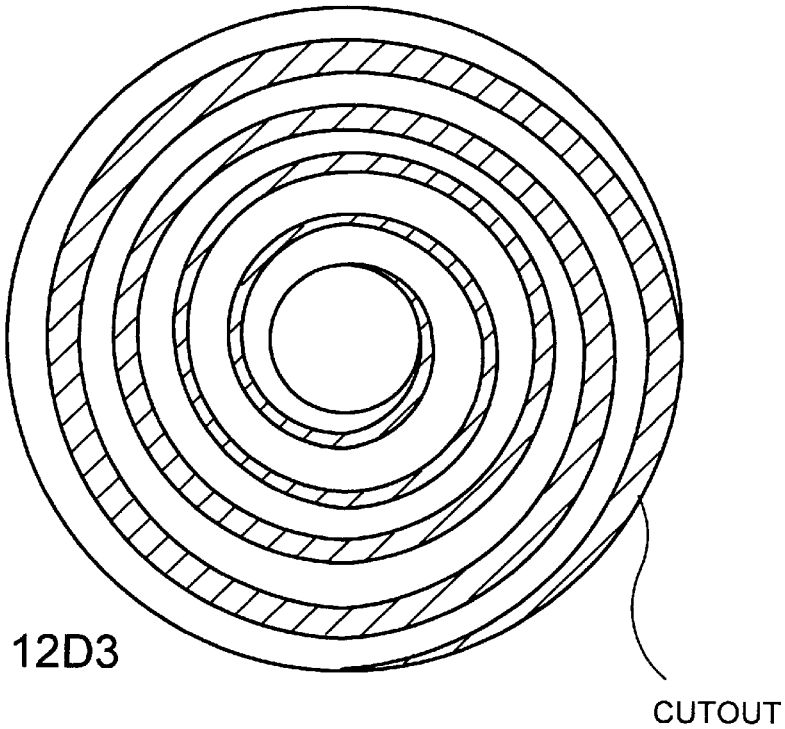
F I G. 12D3
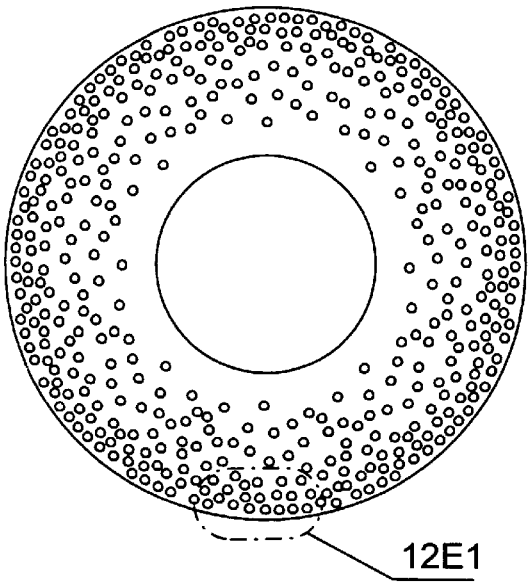
F I G. 12E
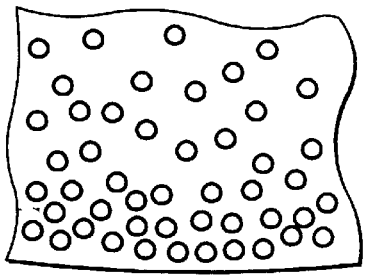
F I G. 12E1

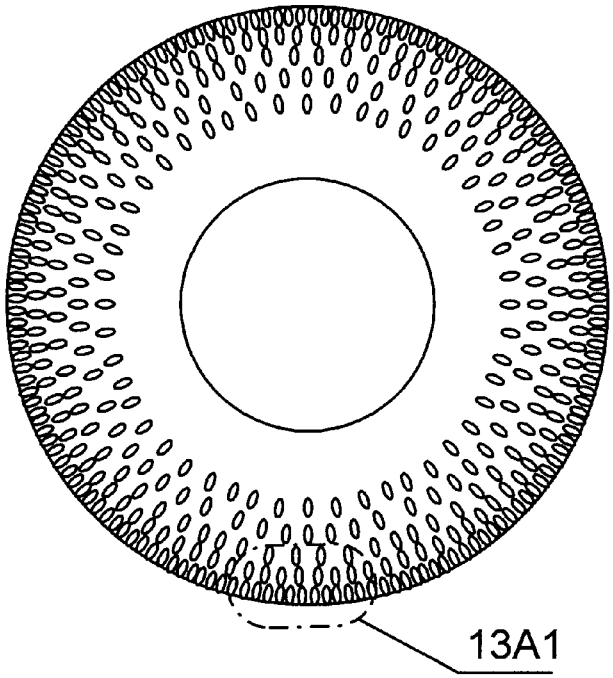
F I G. 13A
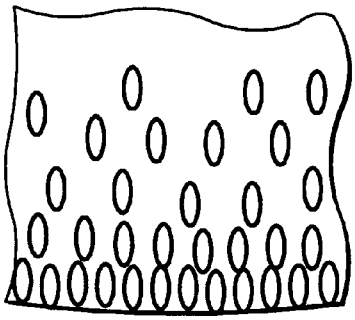
F I G. 13A1

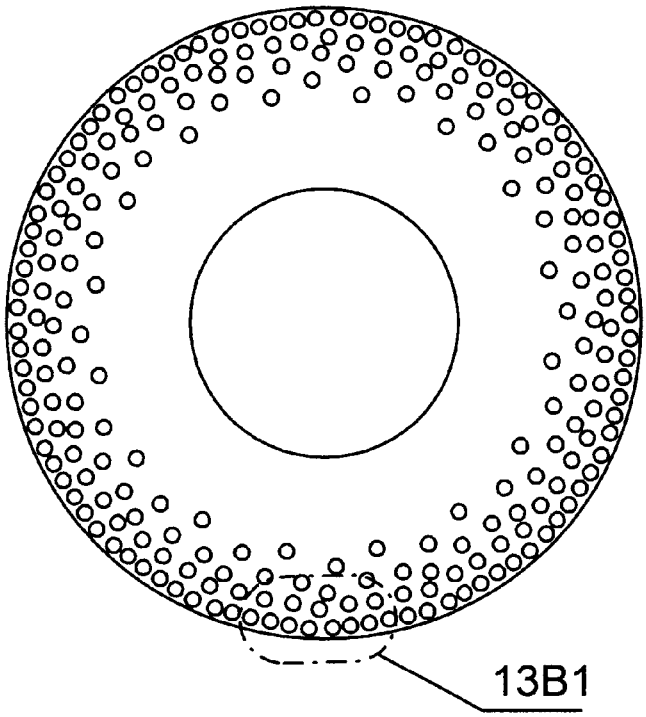
F I G. 13B
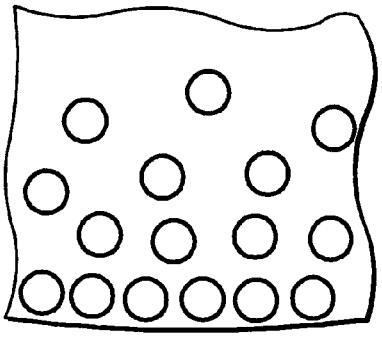
F I G. 13B1

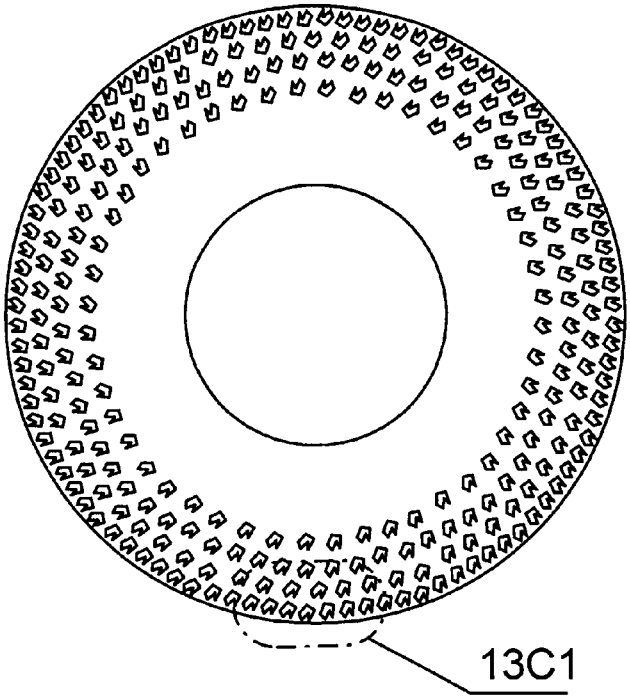
F I G. 13C
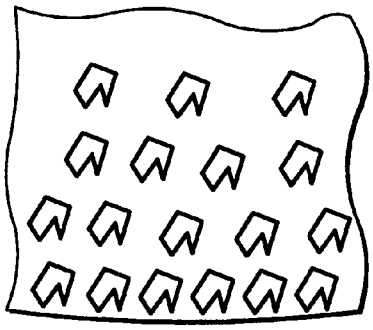
F I G. 13C1

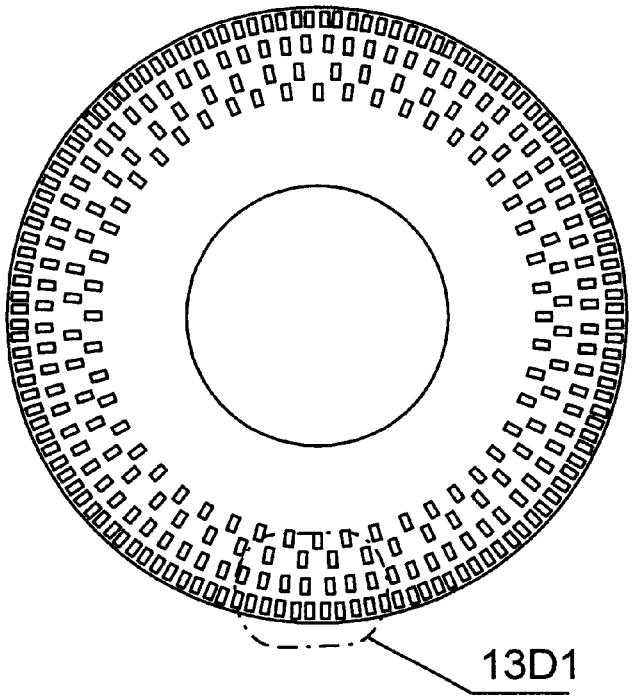
F I G. 13D
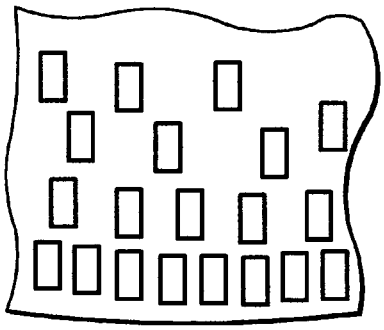
F I G. 13D1

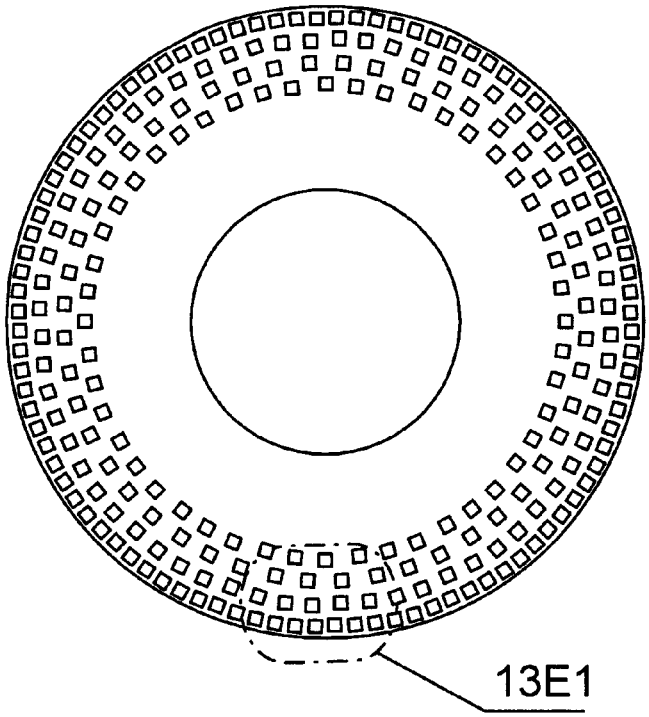
F I G. 13E
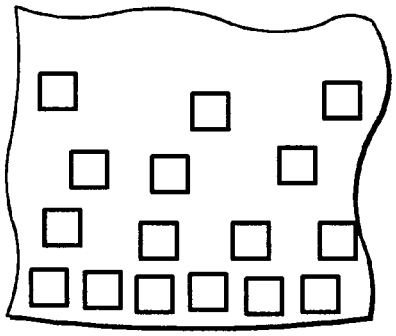
F I G. 13E1

ANTENNA WITH GROUND PLANE HAVING CUTOUTS

CROSS REFERENCE TO RELATED APPLICATIONS

This application is related to U.S. application Ser. No. 08/614,546, filed Mar. 13, 1996, and U.S. application Ser. No. 08/934,249, filed concurrently herewith. Both related applications are assigned to the assignee of the present application.

BACKGROUND OF THE INVENTION

1. Field of the Invention

This invention relates to antenna structures and more particularly to a novel and highly effective antenna structure comprising a radiating element such as a patch antenna in combination with a ground plane constructed to enhance antenna performance.

2. Description of the Prior Art

There is a need for an improved antenna structure for use with a GPS receiver that receives and processes signals from navigation satellites. Antenna structures known heretofore that are capable of optimum performance are too bulky and unwieldy for use in small GPS receivers, especially hand-held receivers. Compact antenna structures that are conventionally employed with GPS receivers do not provide optimum performance. One problem is that they receive signals directly from satellites and, because of ground reflections, also indirectly. This so-called multipath reception causes time measurement errors that can lead to a geographical fix that is erroneous or at least suspect.

A British patent publication No. 2,057,773 of Marconi discloses a large radio transmitting antenna including aerial wires supported in spaced, parallel relation by posts. The ground around the antenna is saturated to a depth of two or three meters with an aqueous solution of calcium sulfate to increase the conductivity of the ground and thereby improve its reflectivity. The ground is permeated to a distance two to three times as far from the antenna as the antenna is tall. In a typical case this can be from 50 to 100 meters from the boundaries of the antenna array.

A European patent publication No. 394,960 of Kokusai Denshin Denwa discloses a microstrip antenna having a radiation conductor and a ground conductor on opposite sides of a dielectric substrate. The spacing between the radiation conductor and the ground conductor, or the thickness of the dielectric substrate, is larger at the peripheral portion of those conductors than at the central portion. Because of the large spacing at the peripheral portion, the impedance at the peripheral portion where electromagnetic waves are radiated is said to be close to the free-space impedance.

A German patent publication No. DE 37 38 513 and its U.S. counterpart U.S. Pat. No. 5,061,938 to Zahn et al. disclose a microstrip antenna including an electrically conductive base plate carrying an electrically insulating substrate on top of which are a plurality of radiating patches. A relatively large spacing is established between the electrically insulating substrate and the base plate at lateral dimensions somewhat larger than lateral dimensions of the patches and also in the vicinity of the patches. The patches and spacings are vertically aligned through either local elevations of the insulating substrate or local indentations in the base plate. The feeder line is thus relatively close to the conductive base plate, and the radiating patch is farther away from the conductive base plate. This is said to improve the radiating characteristics of the patch.

A German patent publication No. DE 43 26 117 of Fischer discloses a cordless telephone with an improved antenna.

A European patent publication No. 318,873 of Toppan Printing Co., Ltd., and Seiko Instruments Inc. discloses an electromagnetic-wave-absorbing element comprising an elongate rectangular body of dielectric material having a bottom portion attachable to an inner wall of an electromagnetically dark room, and peripheral elongate faces extending vertically from the bottom portion. A set of the absorbing elements can be arranged in rows and columns on the wall. An electroconductive ink film is formed on the peripheral faces of the body and has a gradually changing surface resistivity decreasing exponentially lengthwise of the peripheral face toward the bottom portion. The incident electromagnetic wave normal to the wall provided with the rows and columns of absorbing elements is absorbed by a lattice of the electroconductive film during the travel along the electroconductive film. In order to avoid reflection of an incident electromagnetic wave at the boundary between the surrounding air and the absorbing element, the characteristic impedance at the top of the element through which the incident wave enters is close to the impedance of air. In order to avoid reflection at the boundary between the bottom of the element and the wall to which it is attached, the characteristic impedance at the bottom is close to that of the wall. The absorbing element is made of a plastic body with an electroconductive covering and having a variable resistivity or conductivity.

The following prior art is also of interest: U.S. patents to Nelson U.S. Pat. No. 5,592,174 for GPS Multi-Path Signal Reception, Raguenet U.S. Pat. No. 5,248,980 for Spacecraft Payload Architecture, Franchi et al. U.S. Pat. No. 5,204,685 for ARC Range Test Facility, Kobus et al. U.S. Pat. No. 5,170,175 for Thin Film Resistive Loading for Antennas, De et al. U.S. Pat. No. 5,132,623 for Method and Apparatus for Broadband Measurement of Dielectric Properties, Hong et al. U.S. Pat. No. 4,965,603 for Optical Beamforming Network for Controlling an RF Phased Array, Schoen U.S. Pat. No. 4,927,251 for Single Pass Phase Conjugate Aberration Correcting Imaging Telescope, and Bhartia et al. U.S. Pat. No. 4,529,987 for Broadband Micropstrip Antennas with Varactor Diodes.

The prior art as exemplified by the patents discussed above does not disclose or suggest an ideal antenna structure for use in a GPS receiver that receives and processes signals from navigation satellites. What is needed in such an environment is an antenna structure that is very light and portable and adapted to hand-held units of the type used, for example, by surveyors.

OBJECTS AND SUMMARY OF THE INVENTION

An object of the invention is to overcome the problems of the prior art noted above and in particular to provide an antenna structure that reduces multipath signals caused by reflection from the earth, that is physically small yet simulates an infinite ground plane, and that is particularly adapted for use in a GPS receiver that receives and processes signals from navigation satellites. Another object of the invention is to provide an antenna structure that is suitable for hand-held units of the type used by surveyors.

In accordance with one aspect of the invention, an antenna structure is provided comprising a radiating element and a ground plane for the radiating element having a central region closely spaced apart from the radiating element and a peripheral region extending away from the central region. The peripheral region is formed with at least one cutout having an area that increases as radial distance from the central region increases to provide an equivalent sheet resistivity that increases as radial distance from the central region increases.

In accordance with an independent aspect invention, a method is provided comprising the steps of forming an antenna structure comprising a radiating element for receiving broadcast signals directly and, because of reflection of the signals, also indirectly with a time delay, and a ground plane. The ground plane has a central region closely spaced apart from the radiating element and a peripheral region extending away from the central region. The peripheral region is formed with at least one cutout having an area that increases as radial distance from the central region increases to provide a sheet resistivity that increases as radial distance from the central region increases. The antenna structure is employed to receive the broadcast signals. The signals received indirectly because of reflection are attenuated.

Preferably, an antenna structure in accordance with the invention is characterized by a number of additional features: the radiating element is a patch antenna, the radiating element and the ground plane have the same shape (both square, both circular, both octagonal, etc.), and the radiating element is centered over the ground plane (it is also within the scope of the invention, however, for the radiating element and the ground plane to have dissimilar shapes).

The ground plane has minimum linear resistivity adjacent the central region and maximum linear resistivity at the outer edge of the peripheral region. The ground plane can be planar, frustoconical and concave up or down, or frustopyramidal and concave up or down. The ground plane in some embodiments comprises a conductive portion in the central region, for example a disk made of or coated with aluminum.

The ground plane ideally has a sheet resistivity substantially in the range of 0 to 3 ohms per square measured from dead center to a position adjacent the periphery of the radiating element and a sheet resistivity of substantially 500–800 ohms per square measured at the periphery of the ground plane. The sheet resistivity of the peripheral region thus exceeds that in the central region by several orders of magnitude, whereby the ground plane, though physically small, simulates an infinite ground plane.

In the preferred method of practicing the invention, the received electromagnetic signals are GPS signals broadcast by navigation satellites.

BRIEF DESCRIPTION OF THE DRAWING

A better understanding of the objects, features and advantages of the invention can be gained from a consideration of the following detailed description of the preferred embodiments thereof, wherein like reference characters represent like elements or parts, and wherein:

FIG. 12A is a view similar to FIG. 11 showing a portion enlarged to reveal a first type of cutout employed in accordance with the invention; FIG. 12A1 shows a portion of FIG. 12A on an enlarged scale FIGS. 12B and 12B1 are views similar to FIGS. 12A and 12A1, respectively but showing another type of cutout;

FIGS. 12C and 12C1 are views similar to FIGS. 12A and 12A1, respectively but showing another type of cutout;

FIGS. 12D and 12E and 12E1 are views similar to FIGS. 12A and 12A1, respectively but showing other types of cutouts;

FIGS. 12D-1 to 12D-4 show modifications of the structure of FIG. 12D;

FIGS. 13A to 13F show modifications of the structure of FIG. 12E;

DESCRIPTION OF THE PREFERRED EMBODIMENTS

Figure 1:
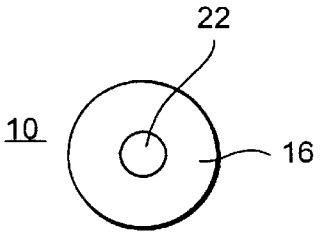
FIG. 1 is a top schematic view, omitting certain details described below, of a first embodiment of an antenna structure in accordance with the invention.
Figure 2:
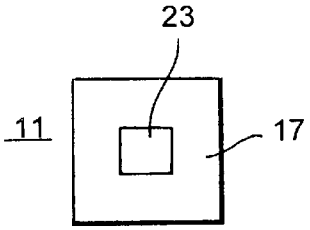
FIG. 2 is a top schematic view, omitting certain details described below, of a second embodiment of an antenna structure in accordance with the invention.
Figure 3:
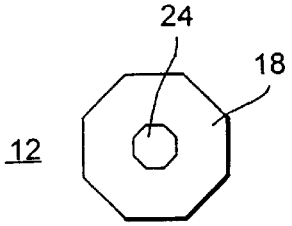
FIG. 3 is a top schematic view, omitting certain details described below, of a third embodiment of an antenna structure in accordance with the invention.

FIGS. 1–3 are top schematic views of antenna structures 10–12 constructed in accordance with the invention; FIGS. 4, 4A, 5, 6 and 6A respectively show other features that can be incorporated in antenna structures in accordance with the invention.

Figure 4:
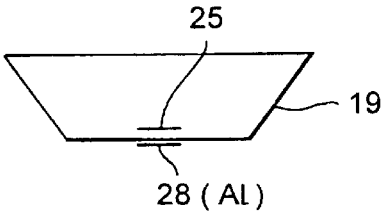
FIGS. 4, 5 and 6 are side sectional schematic views, omitting certain details described below, respectively showing embodiments of concave up, planar, and concave down ground planes, each of which can have any of the shapes in plan view shown in FIGS. 1–3.
Figure 4A:
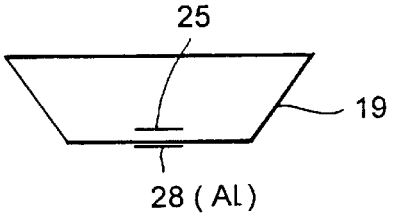
FIG. 4A and 6A are views similar to FIGS. 4 and 6, respectively, showing other embodiments of the invention.
Figure 5:
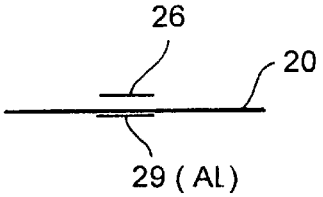
Figure 6:
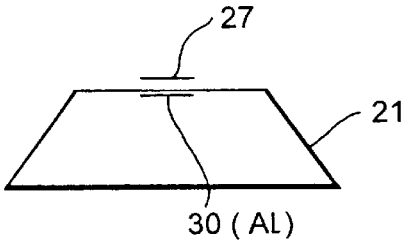
Figure 6A:
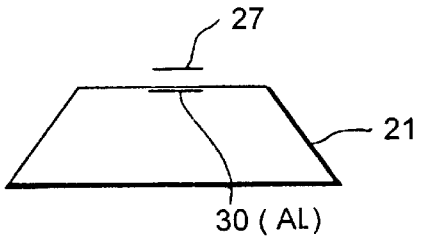

In FIG. 1, the antenna structure 10 comprises a ground plane 16 and a radiating element 22. Both the ground plane 16 and the radiating element 22 are circular. In FIG. 2 both (17, 23) are square; and in FIG. 3 both (18, 24) are octagonal. In each of FIGS. 1–3 the ground planes 16, 17, 18 are illustrated as planar, but, as FIGS. 4, 4A, 6 and 6A illustrate, they need not be. In FIG. 4, the ground plane 19 is frustoconical and concave up, and in FIG. 6 the ground plane 21 is frustoconical and concave down. In FIGS. 4A and 6A the ground planes are frustopyramidal and concave respectively up and down. In FIG. 5 the ground plane 20 is planar. The ground plane can have any of the shapes illustrated in FIGS. 1–3—circular, square or octagonal—combined with any of the shapes illustrated in FIGS. 4, 4A, 5, 6 and 6A. Other shapes both in plan view and in side section are also within the scope of the invention, as those skilled in the art will readily understand.

Figure 8:
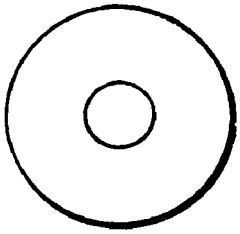
FIGS. 7–10 are top views, omitting certain details described below, of respective embodiments of the invention wherein the radiating element and the ground plane have dissimilar shapes.
Figure 7:
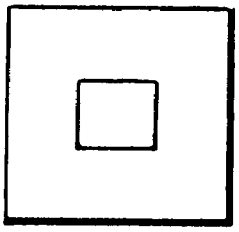
Figure 9:
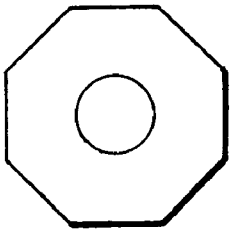
Figure 10:
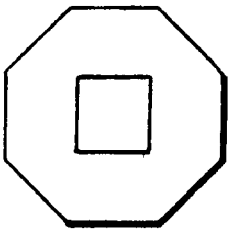

FIGS. 7–10 show embodiments of the invention wherein the radiating element and the ground plane have dissimilar shapes: respectively round/square in FIG. 7, square/round in FIG. 8, round/octagonal in FIG. 9, and square/octagonal in FIG. 10. Other combinations of dissimilar shapes will readily occur to those skilled in the art in light of this disclosure.

While the radiating element used in many applications is preferably a patch, other radiating elements including a quadri filar helix or four-armed spiral on a cylindrical or conical (or frustoconical) support base are well known in the art and can be used in appropriate cases. In a quadri filar helix, typically each spiral arm is fed by a power divider with an integral phase shifter to give each arm a successive 90-degree shift (to 0°, 90°, 180°, and 270°).

At the center of the ground plane there is a conductive portion, which can be formed of a metal such as aluminum or of a nonconductive material such as a woven cloth or a plastic disk impregnated with, or having a coating of, aluminum, another metal, or another conductive material. Aluminum plates 28–30 are illustrated in FIGS. 4, 4A, 5, 6 and 6A (an aluminum plate is of course highly conductive). The aluminum plate has an outer diameter of, say, 5 inches (about 13 cm).

In accordance with the invention, the ground plane has an outer diameter of, say, 13 inches (about 33 cm).

Sheet resistivity is measured in ohms per square. Consider a sheet of homogeneous material of uniform thickness in the shape of a square having a potential applied across it from one edge to the opposite edge. The current that flows is independent of the size of the square. For example, if the size of the square is doubled, the current must flow through double the length of the material, thereby doubling the resistance offered by each longitudinal segment of the square (i.e., each segment extending from the high-potential side of the square to the low-potential side). On the other hand, doubling the size of the square in effect adds a second resistor in parallel to the first and identical to it, thereby reducing the resistance by half. The change in resistance caused by doubling the size of the square is therefore 2×0.5=1. In other words, changing the size of the square does not affect the resistance offered by the square.

In contrast, the effective sheet resistivity varies in accordance with the present invention. The ground plane in the preferred embodiment of the invention has a sheet resistivity substantially in the range of 0 to 3 ohms per square measured from dead center to a position adjacent the periphery of the radiating element and a resistivity of substantially 500–800 ohms per square measured at the periphery of the ground plane. The resistivity of the peripheral region thus exceeds that in the central region by several orders of magnitude, whereby the ground plane, through physically small, simulates an infinite ground plane.

The sheet resistivity of free space is 377 ohms per square. The sheet resistivity of the ground plane at the outer periphery is thus much higher than that of free space.

Figure 11:
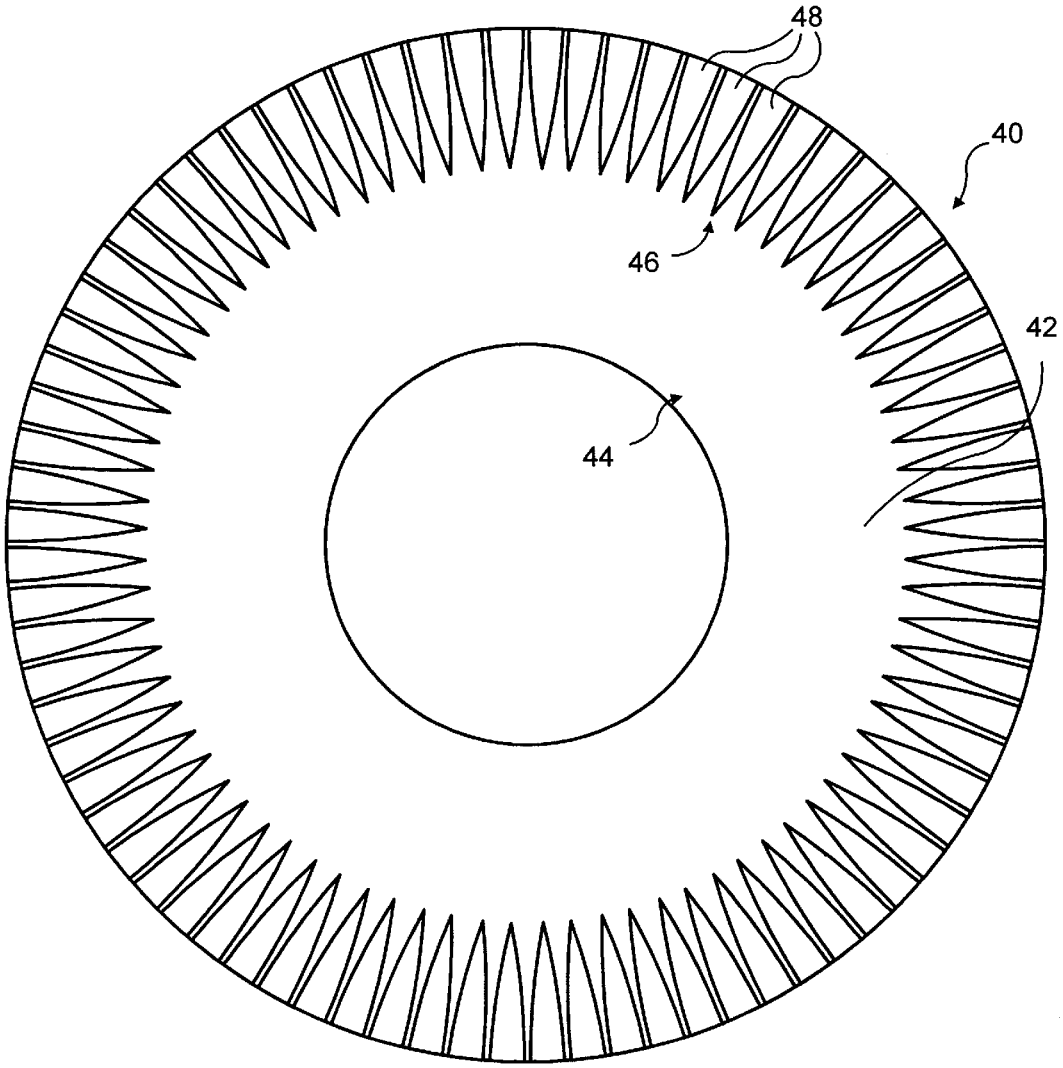
FIG. 11 is a top view showing in more detail a preferred embodiment of an antenna structure in accordance with the invention.

FIG. 11 shows an antenna structure 40 in accordance with the invention. A radiating element as illustrated in any of the preceding figures is employed. FIG. 11 shows a ground plane 42 for the radiating element. The ground plane has a central region 44 closely spaced apart from the radiating element and a peripheral region 46 extending away from the central region 44. The peripheral 46 is formed with at least one cutout 48 having an area that increases as radial distance from the central region 44 increases.

As FIG. 11 shows, the peripheral region 46 can be formed with a plurality of cutouts. Each cutout can be, for example, U-shaped, as shown in FIG. 12A and FIG. 12A1, or V-shaped, as shown in FIG. 12B and FIG. 12B1. Each U or V has a narrow end 50 or 52 near the central region 44 and a wide end 54 or 56 remote from the central region. As FIG. 12C and FIG. 12C1 shows, the cutouts can have edges 58 that form an exponential curve. As FIG. 12D and FIG. 12D4 shows, the cutouts can also be spiral-shaped. For example, the cutout may describe as spiral about a central point, the spiral subtending an arc of at least 360° as measured from the central point or an arc of a multiple of 360° (FIG. 12D-1). The spiral in that case can form loops that are closer together as radial distance from the central region increases (FIG. 12D-2) or that become wider (FIG. 12D-3).

As FIG. 12E and FIG. 12E1 shows, the peripheral region can formed with a plurality of cutouts, each cutout being a closed figure and the cutouts collectively having an area that increases as radial distance from the central region increases. In this case, the cutouts can be elliptical (FIG. 13A and FIG. 13A1), circular (FIG. 13B and FIG. 13B1), polygonal (FIG. 13C and FIG. 13C1), rectangular (FIG. 13D and FIG. 13D1), square (FIG. 13E and FIG. 13E1), or have any other closed shape.

Figure 13F:
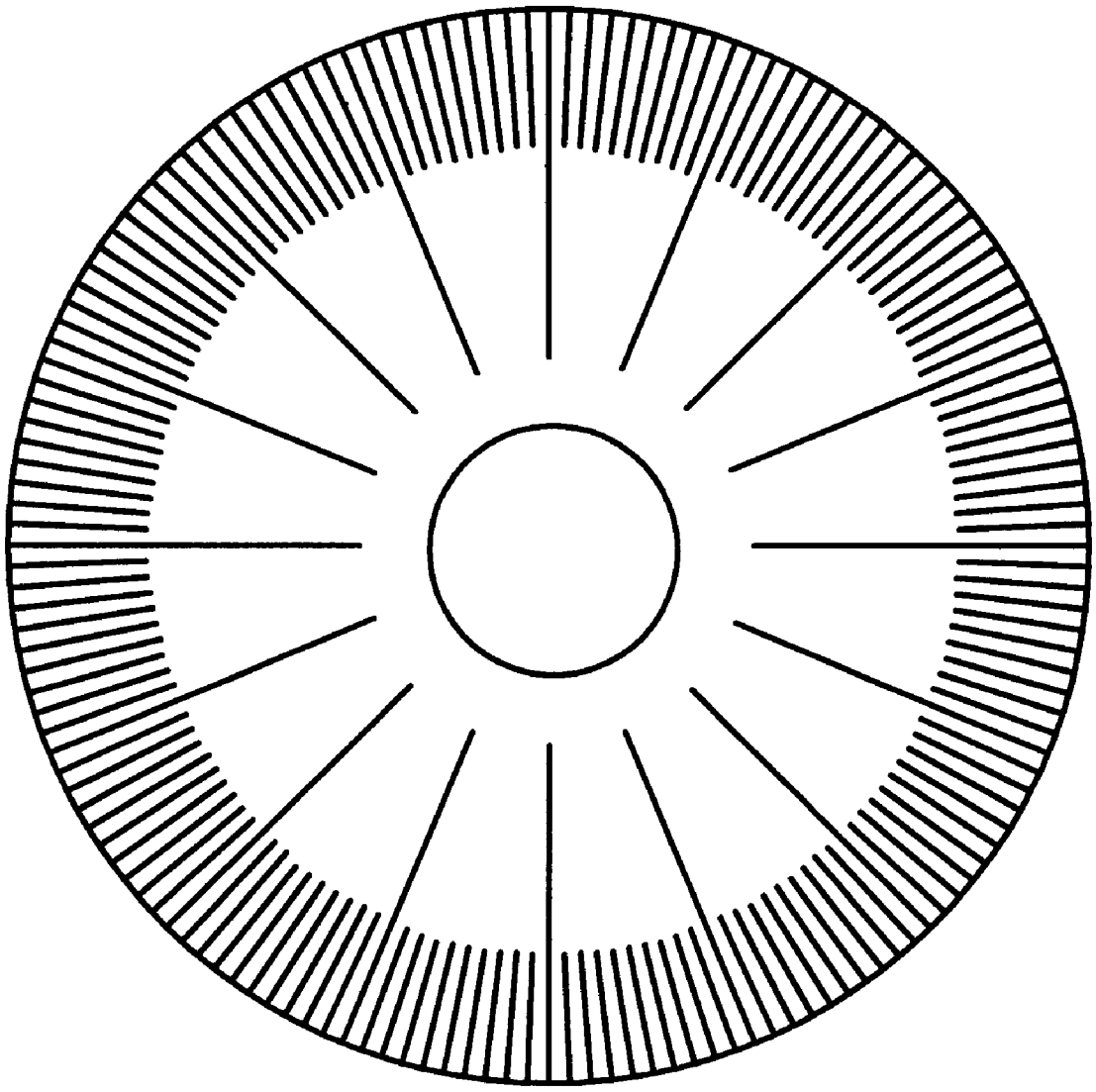

It is also possible for the peripheral region to have a first plurality of cutouts each extending from the central region to the periphery and a second plurality of cutouts interspersed with the first plurality of cutouts and each extending from a position spaced apart from the central region to the periphery (FIG. 13F).

Ideally, resistivity measured from the inner edge to the outer edge has a resistive profile varying in accordance with the following formula:

$$R=3+4.9881((\exp 1.258x)-1) \quad (1)$$

where R is resistivity in ohms per square and x is distance in inches measured form the inner to the outer edge of the ground plane. The graph is plotted in FIG. 14.

The conductive center of the ground plane is 4.97 inches square (about 12.6 cm square) and approximately covers the "hole" in the ground plane. From another standpoint, the ground plane extends radially out approximately from the edges of the conductive center of the ground plane.

If a patch is employed as the radiating element, its dimensions will depend on the dielectric. If air is the dielectric, the patch can be, say, 2 inches (about 5 cm) on a side. If a material of higher dielectric constant is employed, the size of the patch can be reduced to, say, 1.5 inches (about 3.8 cm) on a side.

Figure 14:
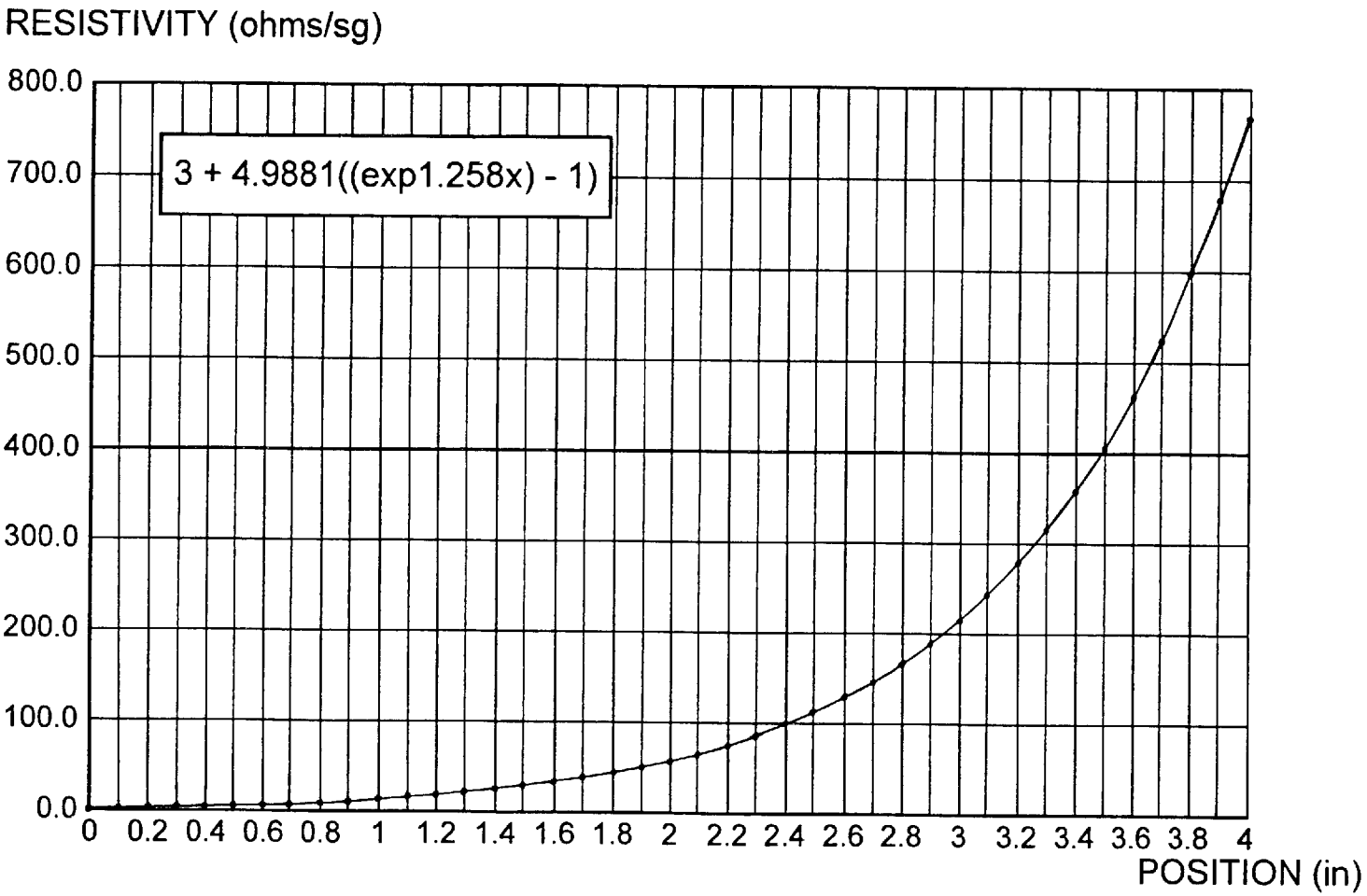
FIG. 14 is a graph showing the resistive profile of a ground plane employed in a preferred embodiment of the invention.

FIG. 14 shows the resistivity profile of the ground plane for the preferred embodiment of the invention. In equation (1) above, consider for example a position 2.4 inches measured radially outward from the inner edge of the ground plane. The resistivity is calculated from equation (1) as follows:

1.258×=3.0192.

exp 3.0192=20.475 (approximately)

20.475−1=19.475

4.9881×(19.475)=97.143 (approximately).

Finally, 3+97.143=100 (approximately), yielding the point (2.4, 100) as illustrated in FIG. 14. A similar calculation produces the other points on the graph.

Figure 15:
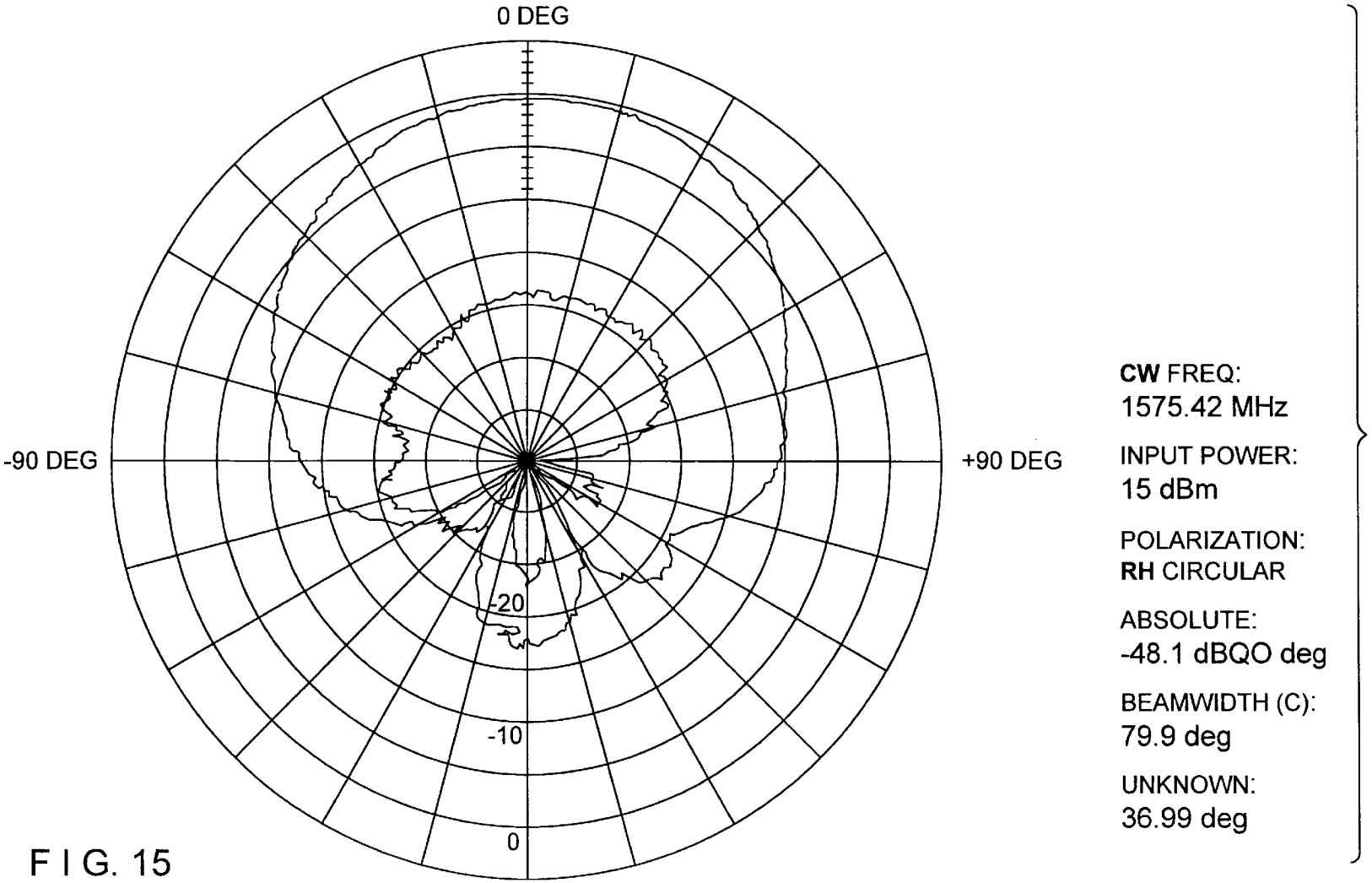
FIGS. 15–18 are plots illustrating an important advantage of the invention.
Figure 16:
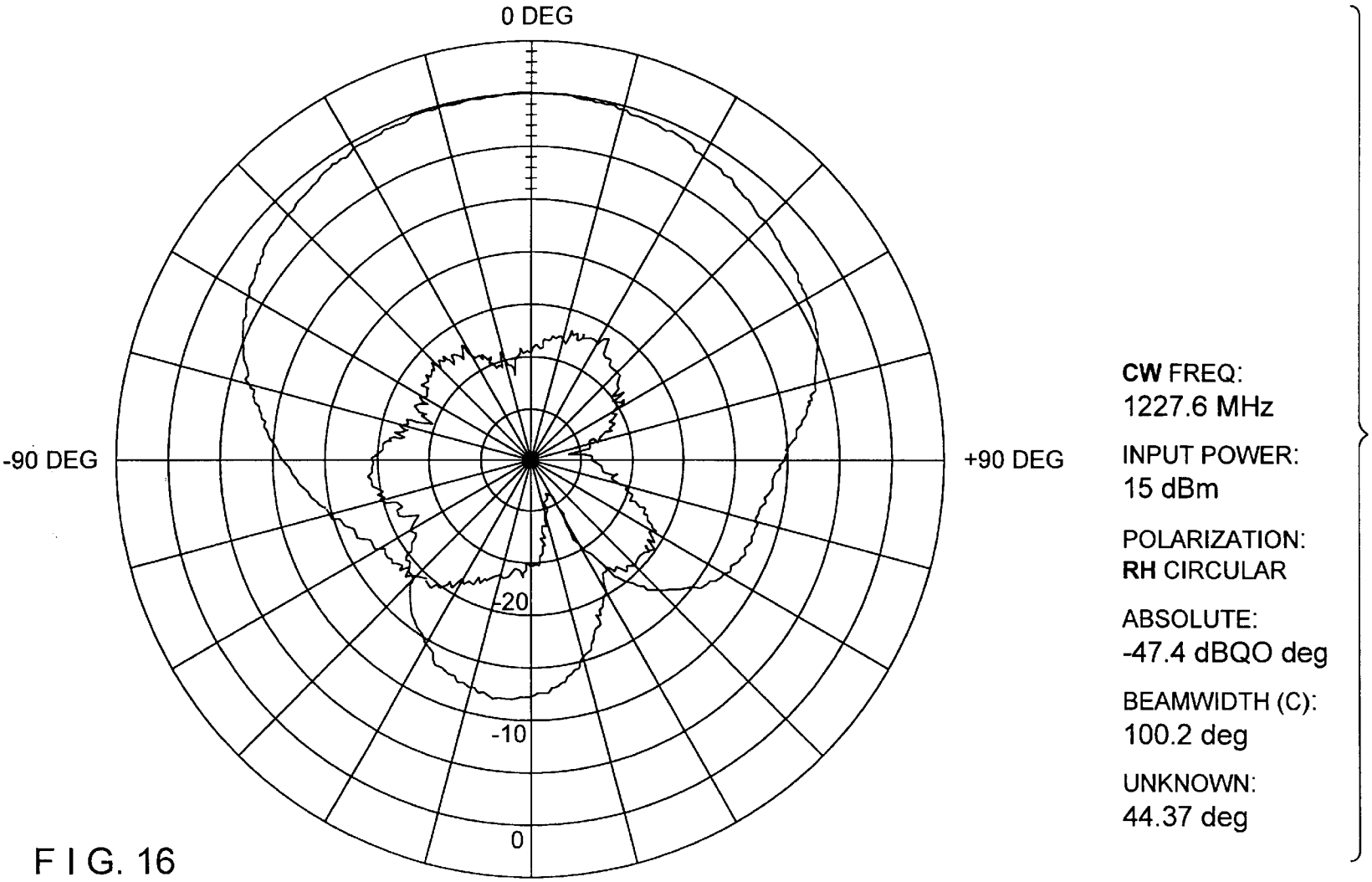
Figure 17:
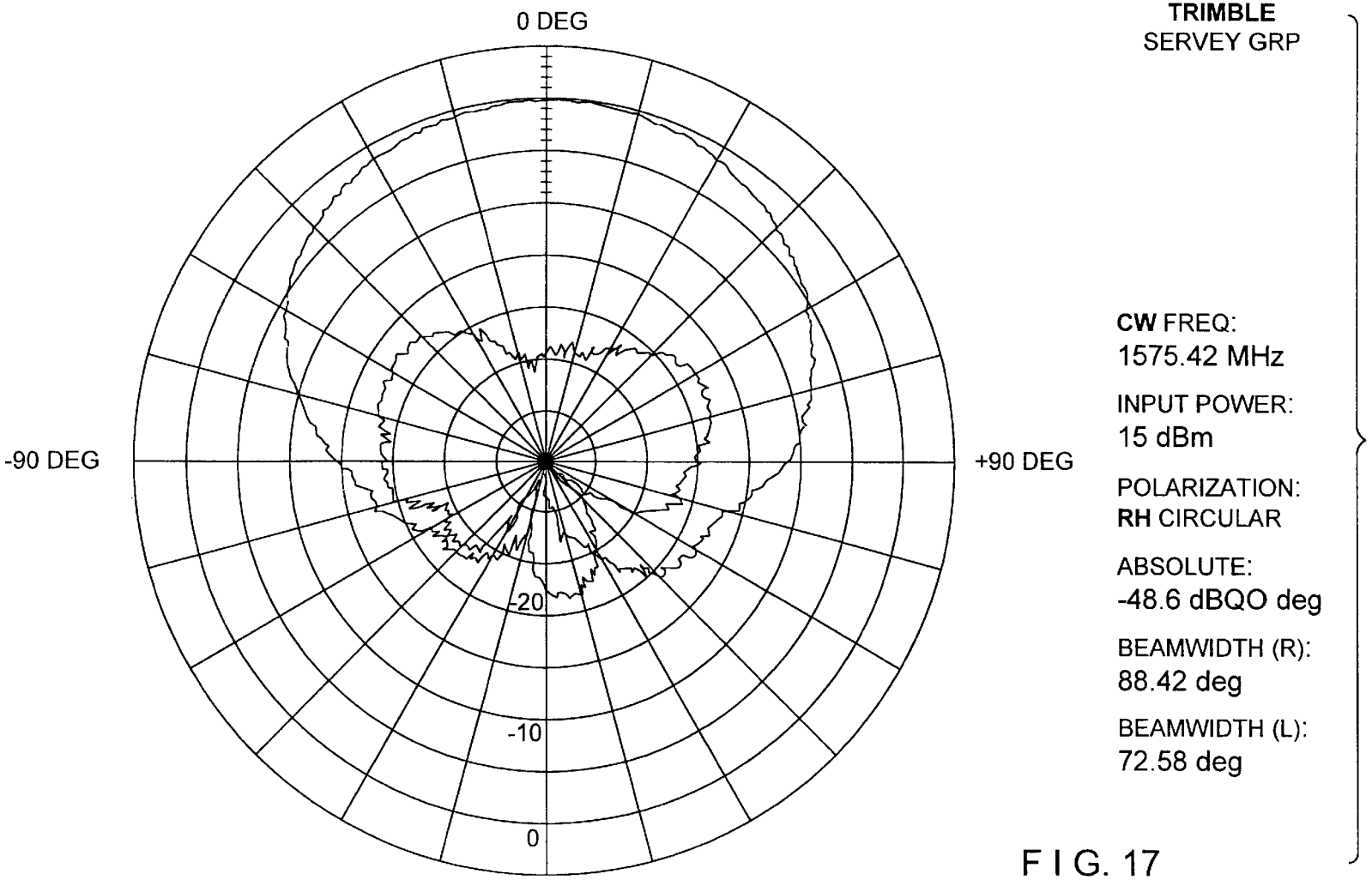
Figure 18:
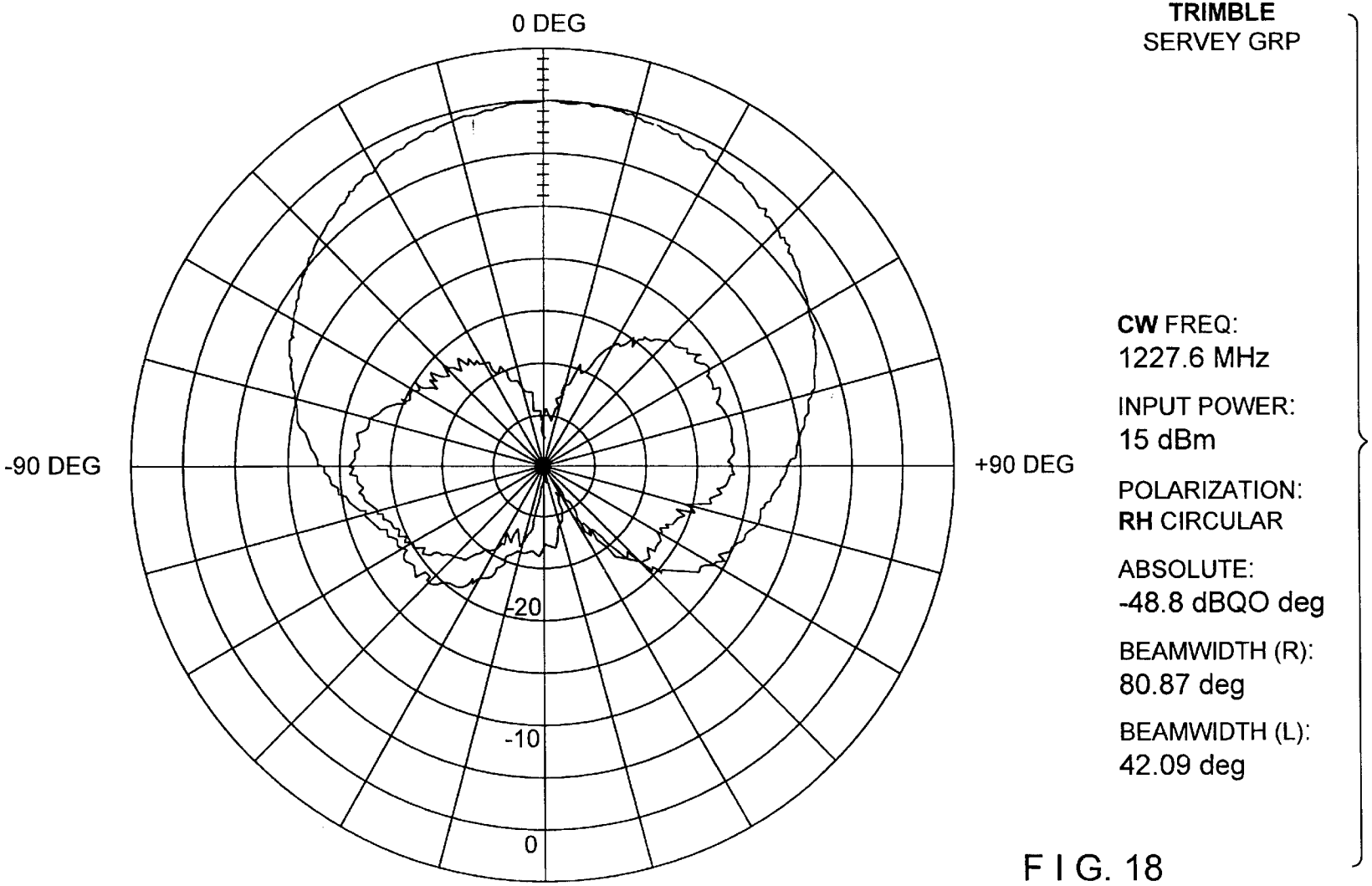

FIGS. 15 and 16 show the antenna pattern without a ground plane (at the two GPS frequencies). FIGS. 17 and 18 show the antenna pattern in accordance with the invention at the two GPS frequencies. The important thing to notice is that the back lobes (the area under the curves on the bottom half of the plots) are reduced in FIGS. 17 and 18. The two lines on each plot represent the received signal strength of a right hand circular polarized (RHCP) signal and a left hand (LHCP) signal, corresponding to a GPS signal and a reflected signal.

The antenna structure described above reduces multipath signals caused by reflection from the earth. The ground plane, though physically small, simulates an infinite ground plane because of its varying sheet resistivity. Signals reflected from the ground and impinging on the underside of the antenna structure are absorbed by the ground plane and dissipated as heat; they do not interact substantially with the antenna proper. The antenna is particularly adapted for use in a GPS receiver that receives and processes signals from navigation satellites. Because of its light weight, it is suitable for hand-held units of the type used by surveyors.

While the preferred embodiments of the invention have been described above, many modifications thereof will readily occur to those skilled in the art upon consideration of this disclosure. The invention includes all subject matter that falls within the scope of the appended claims.

We claim:

1. An antenna structure comprising:

a radiating element and a ground plane for the radiating element having a central region closely spaced apart from the radiating element and a peripheral region extending away from the central region, wherein:

the peripheral region is formed with at least one cutout having an area that increases as radial distance from said central region increases to provide an equivalent sheet resistivity of the ground plane that increases as radial distance from said central region increases.

2. An antenna structure according to claim 1 wherein the peripheral region is formed with a plurality of cutouts, each cutout being substantially U- or V-shaped and having a narrow end near said central region and a wide end remote from said central region.

3. An antenna structure according to claim 1 wherein the peripheral region is formed with a plurality of radial cutouts, each cutout being substantially U- or V-shaped and having a narrow end near said central region and a wide end remote from said central region.

4. An antenna structure according to claim 1 wherein said cutout describes a spiral.

5. An antenna structure according to claim 1 wherein said cutout describes a spiral about a central point, said spiral subtending an arc of at least 360 degrees as measured from said central point.

6. An antenna structure according to claim 1 wherein said cutout describes a spiral about a central point, said spiral subtending an arc of a multiple of 360 degrees as measured from said central point.

7. An antenna structure according to claim 1 wherein said cutout describes a spiral about a central point, said spiral subtending an arc of a multiple of 360 degrees as measured from said central point and forming loops that are closer together or become wider as radial distance from said central region increases.

8. An antenna structure according to claim 1 wherein the peripheral region is formed with a plurality of cutouts, each cutout describing a spiral.

9. An antenna structure according to claim 1 wherein the peripheral region is formed with a plurality of cutouts, each cutout being a closed figure and the cutouts collectively having an area that increases as radial distance from said central region increases.

10. An antenna structure according to claim 1 wherein the peripheral region is formed with a plurality of cutouts, each cutout being elliptical and the cutouts collectively having an area that increases as radial distance from said central region increases.

11. An antenna structure according to claim 1 wherein the peripheral region is formed with a plurality of cutouts, each cutout being circular and the cutouts collectively having an area that increases as radial distance from said central region increases.

12. An antenna structure according to claim 1 wherein the peripheral region is formed with a plurality of cutouts, each cutout being polygonal and the cutouts collectively having an area that increases as radial distance from said central region increases.

13. An antenna structure according to claim 1 wherein the peripheral region is formed with a plurality of cutouts, each cutout being rectangular and the cutouts collectively having an area that increases as radial distance from said central region increases.

14. An antenna structure according to claim 1 wherein the peripheral region is formed with a plurality of cutouts, each cutout being square and the cutouts collectively having an area that increases as radial distance from said central region increases.

15. An antenna structure according to claim 1 wherein the peripheral region has a periphery and is formed with a first plurality of cutouts each extending from the central region to the periphery and a second plurality of cutouts interspersed with the first plurality of cutouts and each extending from a position spaced apart from the central region to the periphery.

16. An antenna structure according to claim 1 wherein the peripheral region has a periphery and is formed with a first plurality of radial cutouts each extending from the central region to the periphery and a second plurality of radial cutouts interspersed with the first plurality of cutouts and each extending from a position spaced apart from the central region to the periphery.

17. An antenna structure according to claim 1 wherein the radiating element comprises a patch antenna.

18. An antenna structure according to claim 1 wherein the radiating element and the ground plane have the same shape.

19. An antenna structure according to claim 1 wherein the radiating element and the ground plane are both square.

20. An antenna structure according to claim 1 wherein the radiating element and the ground plane are both circular.

21. An antenna structure according to claim 1 wherein the radiating element and the ground plane are both octagonal.

22. An antenna structure according to claim 1 wherein the radiating element and the ground plane have dissimilar shapes.

23. An antenna structure according to claim 1 wherein the radiating element is circular and the ground plane is square.

24. An antenna structure according to claim 1 wherein the radiating element is square and the ground plane is circular.

25. An antenna structure according to claim 1 wherein the radiating element is circular and the ground plane is octagonal.

26. An antenna structure according to claim 1 wherein the radiating element is square and the ground plane is octagonal.

27. An antenna structure according to claim 1 wherein the radiating element is centered over the ground plane.

28. An antenna structure according to claim 1 wherein the ground plane is planar.

29. An antenna structure according to claim 1 wherein the ground plane is frustoconical and concave up.

30. An antenna structure according to claim 1 wherein the ground plane is frustoconical and concave down.

31. An antenna structure according to claim 1 wherein the ground plane comprises a conductive disk in the central region.

32. An antenna structure according to claim 1 wherein the ground plane comprises a conductive disk in the central region that is at least in part metallic.

33. An antenna structure according to claim 1 wherein the ground plane comprises a conductive disk in the central region that is at least in part formed of aluminum.

34. An antenna structure according to claim 1 wherein the ground plane has a sheet resistivity approaching 3 ohms per square measured from dead center to the periphery of the radiating element and a sheet resistivity much higher than that of free space measured from dead center to the periphery of the ground plane.

35. An antenna structure according to claim 1 wherein the sheet resistivity in the peripheral region exceeds that in the central region by several orders of magnitude, whereby the ground plane simulates an infinite ground plane.

36. A method comprising the steps of:

forming an antenna structure comprising:

a radiating element for receiving broadcast signals directly and, because of reflection of the signals, also indirectly with a time delay, and a ground plane, wherein:

the ground plane has a central region closely spaced apart from the radiating element and a peripheral region extending away from the central region, and the peripheral region is formed with at least one cutout having an area that increases as radial distance from said central region increases to provide an equivalent sheet resistivity of the ground plane that increases as radial distance from said central region increases; and employing the antenna structure to receive the broadcast signals;

whereby the signals received indirectly because of reflection are attenuated.

37. A method according to claim 36 wherein the signals are broadcast by navigation satellites.

38. A method according to claim 36 wherein the signals are GPS signals.

* * * * *